US009121310B2

(12) United States Patent
Hirata

(10) Patent No.: US 9,121,310 B2
(45) Date of Patent: Sep. 1, 2015

(54) CONTROL SYSTEM FOR VARIABLE VALVE TIMING APPARATUS

(71) Applicant: DENSO CORPORATION, Kariya, Aichi-pref. (JP)

(72) Inventor: Yasuo Hirata, Chita-gun (JP)

(73) Assignee: DENSO CORPORATION, Kariya (JP)

( * ) Notice: Subject to any disclaimer, the term of this patent is extended or adjusted under 35 U.S.C. 154(b) by 4 days.

(21) Appl. No.: 14/079,905

(22) Filed: Nov. 14, 2013

(65) Prior Publication Data

US 2014/0069362 A1 Mar. 13, 2014

Related U.S. Application Data

(62) Division of application No. 12/917,663, filed on Nov. 2, 2010, now abandoned.

(30) Foreign Application Priority Data

Nov. 2, 2009 (JP) ..... 2009-251708
Jan. 6, 2010 (JP) ..... 2010-000944

(51) Int. Cl.
*F01L 1/00* (2006.01)
*F01L 1/344* (2006.01)
(Continued)

(52) U.S. Cl.
CPC ..... *F01L 1/344* (2013.01); *F01L 1/022* (2013.01); *F01L 1/352* (2013.01); *F01L 1/024* (2013.01); *F01L 2001/0537* (2013.01); *F01L 2800/01* (2013.01); *F01L 2800/03* (2013.01)

(58) Field of Classification Search
CPC ..... F02D 2041/001
USPC ..... 123/90.1, 90.15–90.17, 345–348, 321, 123/322
See application file for complete search history.

(56) References Cited

U.S. PATENT DOCUMENTS 7,527,028 B2 * 5/2009 Leone ..... 123/90.15
7,765,966 B2 * 8/2010 Leone ..... 123/90.17
(Continued)

FOREIGN PATENT DOCUMENTS

JP 2004-92534 3/2004
JP 2005-105941 4/2005
(Continued)

OTHER PUBLICATIONS

Office Action (2 pages) dated Feb. 27, 2013, issued in corresponding Japanese Application No. 2009-251708 and English translation (2 pages).
(Continued)

*Primary Examiner* — John Kwon
(74) *Attorney, Agent, or Firm* — Nixon & Vanderhye PC

(57) ABSTRACT

A control system for a variable valve timing apparatus for an internal combustion engine comprises: a electronic control unit having (i) a phase control portion for temporarily reversing a direction of changing a rotational phase of a cam shaft, so that the direction is temporarily changed to an opposite direction of changing the rotational phase of the cam shaft to a target value, when the locked condition is detected after the engine operation is stopped and (ii) a phase-changing amount setting portion for setting a phase-changing amount when controlling the rotational phase of the cam shaft in the reversed direction after the engine operation is stopped. The phase control portion carries out the control of the rotational phase of the cam shaft in the reversed direction based on the phase-changing amount set by the phase-changing amount setting portion, after the engine operation is stopped.

4 Claims, 10 Drawing Sheets

(51) Int. Cl.

| | |
|---|---|
| ***F01L 1/02*** | (2006.01) |
| ***F01L 1/352*** | (2006.01) |
| *F01L 1/053* | (2006.01) |

(56) References Cited

U.S. PATENT DOCUMENTS

| | | | | |
|---|---|---|---|---|
| 8,042,503 | B2 * | 10/2011 | Inoue et al. | 123/90.17 |
| 8,069,829 | B2 * | 12/2011 | Leone | 123/90.17 |
| 2005/0211207 | A1 | 9/2005 | Urushihata et al. | |
| 2006/0260573 | A1 | 11/2006 | Urushihata et al. | |
| 2007/0283911 | A1 | 12/2007 | Nakamura | |
| 2008/0011253 | A1 | 1/2008 | Nakamura | |
| 2009/0101095 | A1 * | 4/2009 | Inoue et al. | 123/90.17 |

FOREIGN PATENT DOCUMENTS

| | | |
|---|---|---|
| JP | 2006-037787 | 2/2006 |
| JP | 4267635 | 2/2009 |

OTHER PUBLICATIONS

Office Action (2 pages) dated Apr. 2, 2013, issued in corresponding Japanese Application No. 2010-000944 and English translation (3 pages).

Office Action (2 pages) dated Jun. 6, 2013, issued in corresponding Japanese Application No. 2009-251708 and English translation (3 pages).

* cited by examiner

CONTROL SYSTEM FOR VARIABLE VALVE TIMING APPARATUS

CROSS REFERENCE TO RELATED APPLICATION

This application is a divisional of U.S. application Ser. No. 12/917,663, filed Nov. 2, 2010, which is based on Japanese Patent Application No. 2009-251708 filed on Nov. 2, 2009 and No. 2010-000944 filed on Jan. 6, 2010, the disclosures of each of which are incorporated herein by reference.

FIELD OF THE INVENTION

The present invention relates to a variable valve timing apparatus of an electrically-driven type, more particularly to a control system for such variable valve timing apparatus, according to which a rotational phase of a cam shaft with respect to a crank shaft of an internal combustion engine is changed by an electric motor in order to change valve timing.

BACKGROUND OF THE INVENTION

Conventionally, a variable valve timing apparatus is known in the art, which is mounted in an internal combustion engine for a vehicle, and according to which a valve timing (a valve opening and/or valve closing timing) for an intake valve and/or an exhaust valve is changed, in order to increase engine output power, to improve fuel consumption ratio, to decrease emission of harmful components contained in exhaust gas, and so on. In most of the variable valve timing apparatuses, which have been put in a market, a rotational phase (a cam shaft phase) of a cam shaft with respect to a crank shaft is changed by an electric motor or oil pressure (a hydraulic actuator) to thereby change valve timings of the intake valve and the exhaust valve driven by the cam shaft.

According to a variable valve timing apparatus having an electric motor as a driving source, for example, as disclosed in Japanese Patent No. 4,267,635, the cam shaft phase (valve timing) is changed during engine operation is stopped. And an operating amount of the electric motor during an engine stopped period is made smaller than that during an engine operating period, in order to decrease operating sound of the variable valve timing apparatus during the engine stopped period.

When the cam shaft phase is changed during the engine operation is stopped (that is, the rotation of the crank shaft as well as the cam shaft is stopped), the variable valve timing apparatus is operated from its standing-still. Therefore, it is necessary to make an output torque of the electric motor at a larger value, so that the output torque of the electric motor overcomes static friction forces of respective portions of the variable valve timing apparatus to drive the same.

However, the necessary output torque is not considered in the above mentioned prior art (JP Patent No. 4,267,635). According to the above prior art, when the cam shaft phase is changed during the engine operation is stopped, the operating amount of the electric motor is simply made smaller than that during the engine operating period. It may happen that the output torque of the electric motor may come short and thereby the variable valve timing apparatus may not be driven. As a result, it may happen that the cam shaft phase may not be changed.

SUMMARY OF THE INVENTION

The present invention is made in view of the above problems. It is an object of the present invention to provide a control system for a variable valve timing apparatus of an electrically-driven type, according to which a cam shaft phase is surely changed during the engine operation is stopped and at the same time operating sound may be decreased.

According to a feature of the present invention, a control system for a variable valve timing apparatus of an electrically-driven type for an internal combustion engine has a phase variable mechanism for changing a rotational phase of a cam shaft with respect to a crank shaft by controlling rotation of an electric motor. The control system for the variable valve timing apparatus has an electronic control unit for controlling the rotation of the electric motor. In a case the rotational phase of the cam shaft is changed during the engine operation is stopped, the electronic control unit carries out a power supply increase control in order to increase power supply amount to the electric motor to a target power increase amount at a beginning of the power supply to the electric motor. And, after the power supply increase control, the electronic control unit carries out a feedback control in order that an actual changing speed of the rotational phase of the cam shaft is controlled to be equal to a target changing speed.

According to the above feature, the power supply increase control is carried out when changing (advancing or retarding) the rotational phase of the cam shaft during the engine operation is stopped, so that the power supply to the electric motor is increased to the power increase amount at the beginning of the power supply to the electric motor. As a result, the output torque of the electric motor can be properly increased to drive the VVT apparatus, and thereby the cam shaft phase can be surely changed. The power increase amount corresponds to such a power supply amount, with which a torque necessary for driving the VVT apparatus (that is, a torque necessary for overcoming the static friction forces of respective portions of the VVT apparatus) during the engine operation is stopped. For example, such power supply amount corresponds to a duty ratio higher than a ratio of 80%, which is larger than a power-supply duty ratio (that is, a power holding duty ratio) necessary for keeping the cam shaft phase at a constant value during the engine is operated.

In addition, after the above power supply increase control, the feedback control is carried out for the power supply to the electric motor, so that the actual changing speed of the rotational phase of the cam shaft is controlled to be equal to the target changing speed. Accordingly, the changing speed of the cam shaft phase is prevented from becoming too fast and the operating sound of the VVT apparatus can be decreased.

When, the cam shaft phase is changed, a load torque for compressing a valve spring of an intake valve or an exhaust valve becomes larger, while the load torque becomes smaller in the case that the valve spring is expanded. Therefore, since the actual changing speed of the cam shaft phase varies depending on the load torque of the VVT apparatus during its power supply increase control, the actual changing speed of the cam shaft phase during the power supply increase control is one of parameters which accurately reflect the load torque of the VVT apparatus.

The above point is taken into consideration. According to another feature of the invention, during the feedback control for the changing speed of the rotational phase, the electronic control unit sets at least one of a gain for the feedback control for the changing speed of the rotational phase and an initial value for the power supply increase control, depending on the actual changing speed of the rotational phase of the camshaft during the power supply increase control.

According to such feature, it is possible to change the gain for the feedback control for the changing speed of the rotational phase and the initial value for the power supply increase control, depending on the load torque of the VVT apparatus. Namely, it is possible to set the gain for the feedback control for the changing speed of the rotational phase and the initial value for the power supply increase control at respective proper values.

When the cam shaft phase is changed during the engine operation is stopped, the load torque for the VVT apparatus may easily vary and the changing speed of the cam shaft phase may easily vary. Therefore, according to a further feature of the invention, during the feedback control for the changing speed of the rotational phase, the power supply amount may be feedback controlled by use of an integral term. According to such feature, it is possible to effectively reduce a deviation between the actual changing speed and the target changing speed of the cam shaft phase during the feedback control, and thereby to stabilize the actual changing speed of the cam shaft phase.

According to a further feature of the invention, a control system for a variable valve timing apparatus for an internal combustion engine has a phase variable mechanism for transmitting rotational force of an electric motor to a cam shaft of the engine to thereby change a rotational phase of the cam shaft with respect to a crank shaft, and an electronic control unit for controlling rotation of the electric motor. The electronic control unit has;

a target value control portion for controlling the rotational phase of the cam shaft to a target value after engine operation is stopped;

a locked condition detecting portion for detecting whether a locked condition, in which a change of the rotational phase is stopped or close to a stopped condition, has occurred during an operation of the target value control portion for controlling the rotational phase of the cam shaft to the target value; and a phase control portion for temporarily reversing a direction of changing the rotational phase of the cam shaft, so that the direction is temporarily changed to an opposite direction of changing the rotational phase of the cam shaft to the target value, when the locked condition is detected.

According to a still further feature of the invention, the phase control portion temporarily reverses direction of power supply to the electric motor, so that the direction of changing the rotational phase of the cam shaft is temporarily reversed.

According to a still further feature of the invention, the electronic control unit further has a phase-changing amount setting portion for setting a phase-changing amount when controlling the rotational phase of the cam shaft in the reversed direction, and the phase control portion carries out the control of the rotational phase of the cam shaft in the reversed direction based on the phase-changing amount set by the phase-changing amount setting portion.

According to a still further feature of the invention, in a case that the rotational phase of the cam shaft is controlled to the target value after the rotational phase of the cam shaft has been temporarily controlled in the reversed direction by the phase control portion, the electronic control unit carries out a power supply increase control for the power supply to the electric motor for a predetermined time period at starting the power supply increase control, so that the power supply amount to the electric motor is increased to a predetermined power increase value.

According to a still further feature of the invention, the electronic control unit has a memory portion for storing information relating to occurrence of the locked condition and release of the locked condition, and the phase control portion controls the rotational phase of the cam shaft in the reversed direction based on the information relating to the occurrence and/or release of the locked condition.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENTS

First Embodiment

Figure 1:
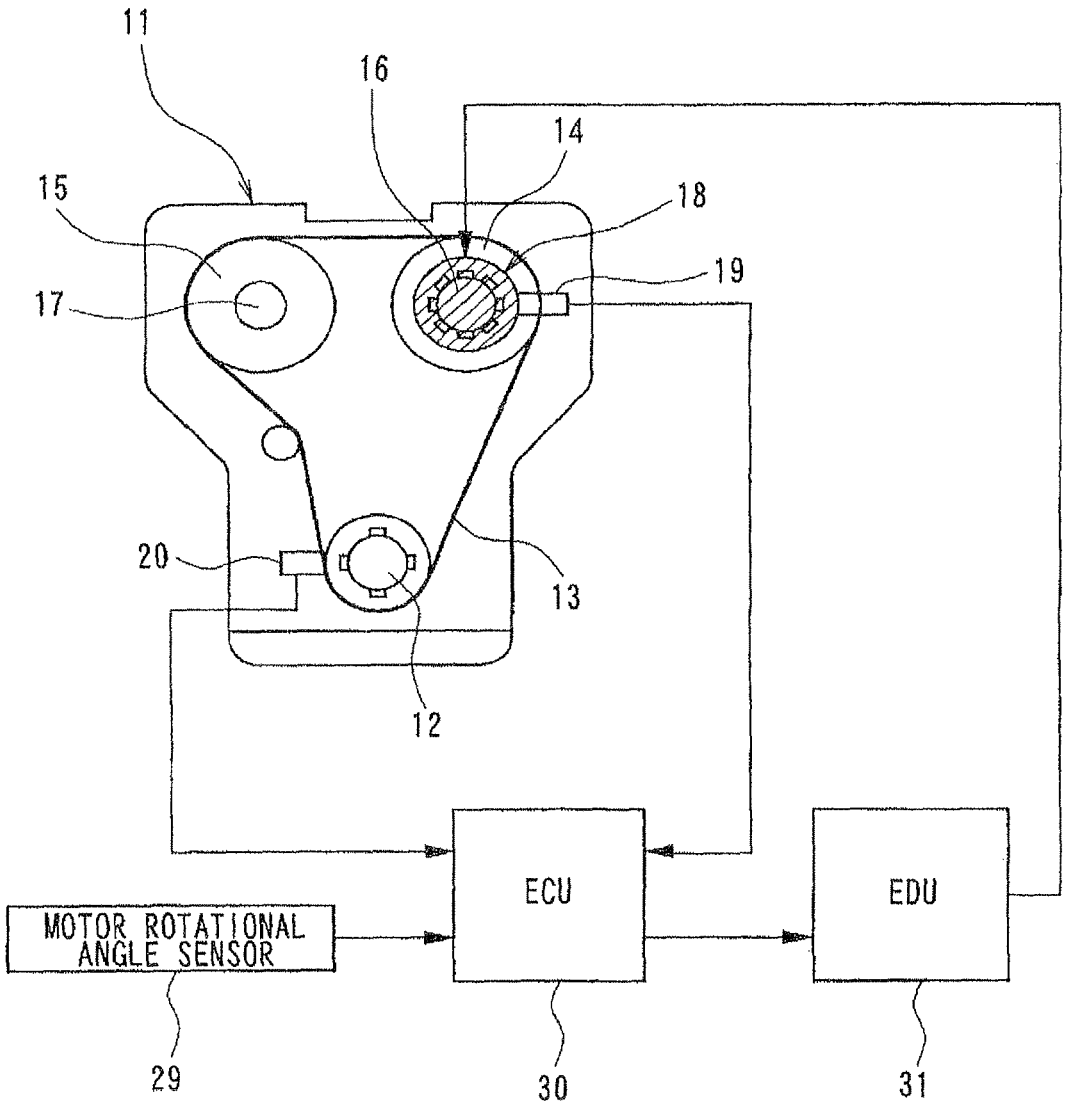
FIG. 1 is a schematic view showing a control system for a variable valve timing apparatus according to a first embodiment of the present invention.

Embodiments of the present invention will be explained with reference to the embodiments shown in the drawings, wherein the present invention is applied to a variable valve timing apparatus for an intake valve.

At first, an entire structure for a variable valve timing control system will be explained with reference to FIG. 1.

A driving power of an internal combustion engine 11 is transmitted by a timing chain (or a timing belt) 13 from a crank shaft 12 to a cam shaft 16 for an intake valve as well as to a cam shaft 17 for an exhaust valve via respective sprockets 14 and 15. A variable valve timing (VVT) apparatus 18 of an electrically-driven type is provided at the cam shaft 16 for the intake valve. A rotational phase (a cam shaft phase) of the cam shaft 16 with respect to the crank shaft 12 is changed by the variable valve timing (VVT) apparatus 18, so that a valve timing (a valve opening timing and/or a valve closing timing) for the intake valve (not shown), which is driven to open and close by the cam shaft 16, is controlled (changed).

A cam angle sensor 19 is provided at an outer periphery of the cam shaft 16 so as to generate a cam angle signal for every predetermined cam angle in accordance with the rotation of the cam shaft 16. A crank angle sensor 20 is provided at an outer periphery of the crank shaft 12 so as to generate a crank angle signal for every predetermined crank angle in accordance with the rotation of the crank shaft 12.

An outline structure for the VVT apparatus 18 will be explained with reference to FIG. 2. The structure of the VVT apparatus 18 should not be limited to that shown in FIG. 2, but may be modified in various ways.

A phase variable mechanism 21 of the VVT apparatus 18 is composed of an outer gear member 22 having an internal gear coaxially arranged with the cam shaft 16, an inner gear member 23 having an external gear coaxially arranged with the cam shaft 16 and in an inside of the outer gear member 22, and a planet gear member 29 arranged between the outer and inner gear members 22 and 23 and engaged with each of them. The outer gear member 22 is integrally rotated with the sprocket 14, which is rotated in a synchronized manner with the crank shaft 12, while the inner gear member 23 is integrally rotated with the cam shaft 16. The planet gear member 24 is rotated around the inner gear member 23, while the planet gear member 24 is engaged with both of the outer and inner gear members 22 and 23, so that rotational force of the outer gear member 22 is transmitted to the inner gear member 23. At the same time, when an orbital speed of the planet gear member 24 with respect to the rotational speed of the outer gear member 22 is changed, the rotational phase (the cam shaft phase) of the inner gear member 23 with respect to the outer gear member 22 can be adjusted.

The engine 11 has an electric motor 26 for changing the orbital speed of the planet gear member 24. A rotational axis 27 of the electric motor 26 is coaxially arranged with the cam shaft 16, the outer gear member 22 and the inner gear member 23. A supporting shaft 25 for the planet gear member 24 is linked with the rotational axis 27 of the electric motor 26 via a connecting rod 28, which is extending in a radial direction from the rotational axis 27. According to the above structure, the planet gear member 24 is rotated at the supporting shaft 25 while moving around (an orbital movement) an outer periphery of the inner gear member 23, in accordance with the rotation of the electric motor 26. A motor rotational angle sensor 29 is provided at the electric motor 26 (FIG. 1) so as to generate a motor rotational angle signal for every predetermined rotational angle in synchronization with the rotation of the electric motor 26. The rotational angle as well as rotational speed of the electric motor 26 is detected based on output signals from the motor rotational angle sensor 29.

The outer gear member 22, the inner gear member 23 and the planet gear member 24 are so structured that the cam shaft 16 is rotated in a normal operation at a speed, which is a half of the rotational speed of the crank shaft 12. The rotational speed of the electrical motor 26 is adjusted with respect to the rotational speed of the cam shaft 16 (which is rotated at the half speed of the crank shaft 12 in the normal operation), so that the valve timing (that is, the cam shaft phase) for the intake valve is controlled.

When the valve timing is not changed, the rotational speed of the electric motor 26 is set at the speed of the outer gear member (that is, the half of the rotational speed of the crank shaft 12). In other words, the speed of the orbital movement of the planet gear member 24 is controlled to be equal to the rotational speed of the outer gear member 22, so that a difference of the rotational phase between the outer and inner gear members 22 and 23 is held in a status quo and thereby the valve timing (the cam shaft phase) is maintained as it is.

When electrical power supply to the electric motor 26 is cut off, the rotational axis 27 of the electric motor 26 is rotated in synchronization with the outer gear member 22. Namely, the rotational speed of the electric motor 26 may be made to be equal to the rotational speed of the outer gear member 22 (that is, the half of the rotational speed of the crank shaft 12).

When the valve timing is changed, the rotational speed of the electric motor 26 is changed with respect to the rotational speed of the outer gear member 22 in order that the orbital moving speed of the planet gear member 24 is changed with respect to the rotational speed of the outer gear member 22. As a result, the difference of the rotational phase between the outer and inner gear members 22 and 23 is changed to adjust (change) the valve timing (the camshaft phase).

For example, in case of advancing the valve timing, the rotational speed of the electric motor 26 is changed to be higher than the rotational speed of the outer gear member 22, so that the orbital moving speed of the planet gear member 24 is changed to be higher than the rotational speed of the outer gear member 22. As a result, the rotational phase of the inner gear member 23 is advanced with respect to the outer gear member 22. Namely the valve timing (the cam shaft phase) is advanced.

On the other hand, incase of retarding the valve timing, the rotational speed of the electric motor 26 is changed to be lower than the rotational speed of the outer gear member 22, so that the orbital moving speed of the planet gear member 24 is changed to be lower than the rotational speed of the outer gear member 22. As a result, the rotational phase of the inner gear member 23 is retarded with respect to the outer gear member 22. Namely the valve timing (the cam shaft phase) is retarded.

As shown in FIG. 1, outputs of the above mentioned various sensors are inputted into an engine control unit (hereinafter also referred to as ECU) 30. The ECU 30 is composed of a micro-computer and carries out various kinds of engine control programs which are stored in ROM (a memory device), to thereby control fuel injection amount for a fuel injection device (not shown) and ignition timings for an ignition device (not shown) depending on engine operating conditions.

The ECU 30 calculates, during engine operation, an actual rotational phase (an actual cam shaft phase) of the cam shaft 16 with respect to the crankshaft 12, based on the output signals from the cam angle sensor 19 and crank angle sensor 20. The ECU 30 further calculates a target cam shaft phase depending on an operational condition of the engine. Then, the ECU 30 calculates a target motor rotational speed, based on a deviation between the target camshaft phase (a target valve timing) and the actual earn shaft phase (an actual valve timing) and based on the engine rotational speed. A signal for the calculated, target motor rotational speed is outputted to an electrical motor driving unit (also referred to as EDU) 31. The EDU 31 carries out a feedback control for a power-supply duty ratio (a power-supply control amount) to the electric motor 26, so that a deviation between the target motor rotational speed and the actual motor rotational speed may become smaller. As a result, a feedback control is carried out in such a way that the actual cam shaft phase is controlled to be closer to (and finally equal to) the target cam shaft phase. The above function of the EDU 31 may be included in the ECU 30.

The ECU 30 (or the ECU 30 and the EDU 31) carries out the process for the phase control shown in FIGS. 4A and 4B (described below), according to which the ECU 30 carries out a power-supply increase control in order to set the power-supply duty ratio (the power-supply control amount) for the electric motor 26 at a predetermined power increase amount, when starting with the power supply to the electric motor 26 so that the cam shaft phase is changed (advanced or retarded) during the engine operation is stopped. After the power-supply increase control, the ECU 30 further carries out a feedback control for a phase-change speed, according to which the power-supply duty ratio is controlled so that an actual changing speed for the cam shaft phase coincides with a target changing speed. Since the cam shaft phase is changed during the engine operation is stopped, a main relay (not shown) for a power supply line is turned on even after an ignition switch (not shown) is turned off, so that power supply to the ECU 30, the electric motor 26 and so on can be continuously carried out.

Figure 3:
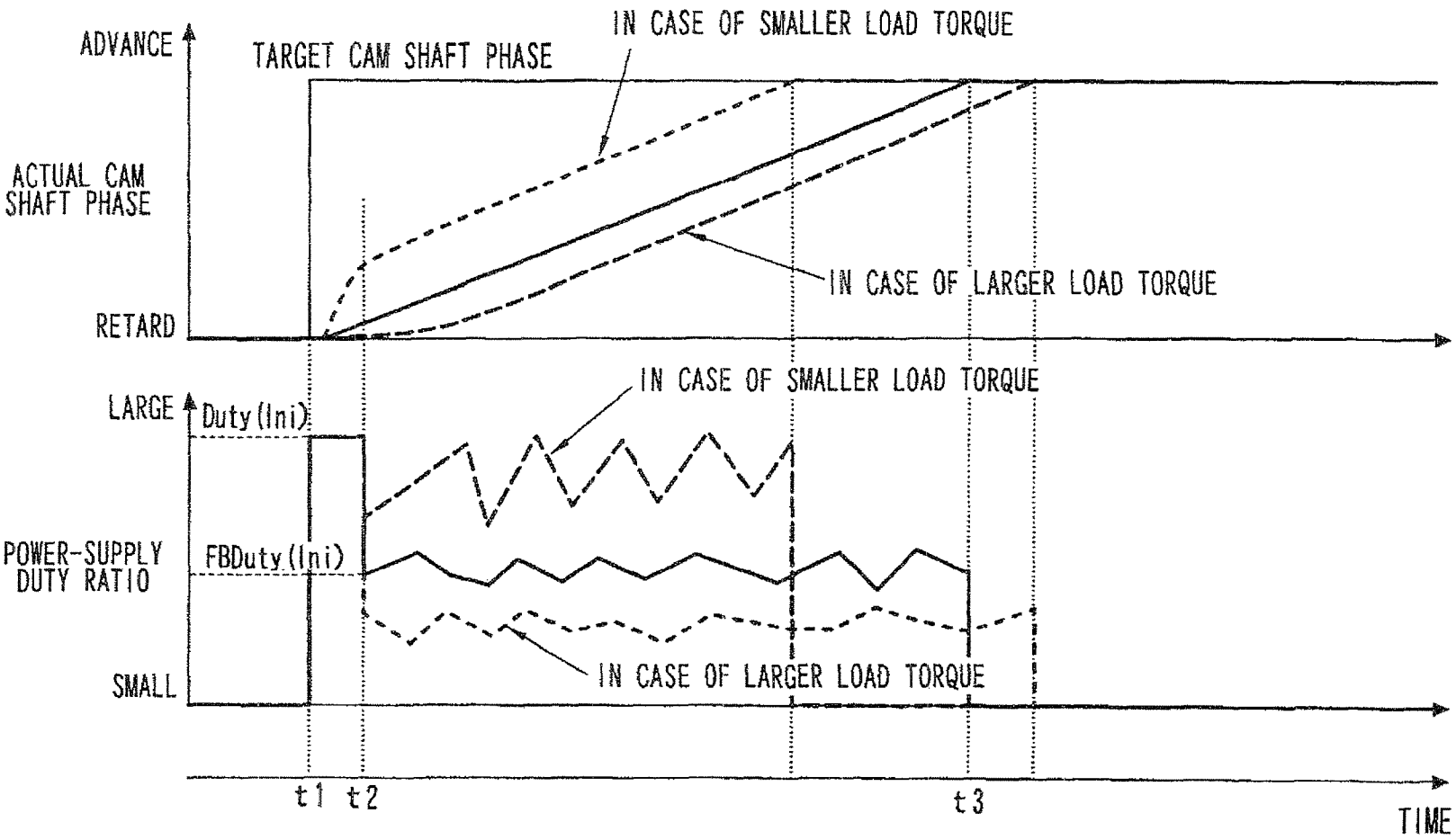
FIG. 3 is a timing chart for explaining an example of carrying out phase control during engine operation is stopped.

As shown in FIG. 3, when the camshaft phase is changed during the engine operation is stopped, the power-supply increase control is carried out at a time point t1, at which the target cam shaft phase is changed in an advancing direction (or in a retarding direction) and thereby the deviation between the target cam shaft phase and the actual cam shaft phase becomes larger than a predetermined value. In the power-supply increase control, the power-supply duty ratio "Duty" to the electric motor 26 is set at the predetermined power increase amount "Duty(Ini)". As a result, the output torque of the electric motor 26 is properly increased so as to drive the VVT apparatus 18 and then to change the camshaft phase. The predetermined power increase amount "Duty(Ini)" corresponds to a power-supply duty ratio, with which a torque necessary for driving the VVT apparatus 18 (that is, a torque necessary for overcoming the static friction forces of respective portions of the VVT apparatus 18) during the engine operation is stopped. For example, such power-supply duty ratio ("Duty(Ini)") is higher than a ratio of 80%, which is larger than a power-supply duty ratio (that is, a power holding duty ratio) necessary for keeping the cam shaft phase at a constant value during the engine is operated.

At a time point t2, after a predetermined period from the time point t1 at which the power-supply increase control has been started, the feedback control is carried out for the phase-change speed. In the feedback control, the power-supply duty ratio "Duty" is controlled so that the actual changing speed for the cam shaft phase coincides with the target changing speed. As a result, the changing speed for the cam shaft phase is prevented from becoming too fast, to thereby decrease operating sound of the VVT apparatus 18.

When the cam shaft phase for the VVT apparatus 18 is changed, a load torque becomes larger in the case that a valve spring for the intake valve is compressed, while the load torque becomes smaller in the case that the valve spring is expanded. Therefore, since the actual changing speed for the cam shaft phase varies depending on the load torque of the VVT apparatus 18 during its power increase control, the actual changing speed for the cam shaft phase during the power increase control is one of parameters which accurately reflect the load torque of the VVT apparatus 18.

According to the present embodiment, during the feedback control for the phase-change speed, a gain for the feedback control for the phase-change speed (for example, an integral gain used for calculating an integral term) and an initial value "FBDuty(Ini)" for the power-supply duty ratio are decided depending on the actual changing speed of the cam shaft phase during the power-supply increase control (that is, the parameter accurately reflecting the load torque for the VVT apparatus 18). As a result, the gain for the feedback control for the phase-change speed as well as the initial value "FBDuty (Ini)" for the power-supply duty ratio is changed depending on the load torque for the VVT apparatus 18, in order that the gain, for the feedback control for the phase-change speed as well as the initial value "FBDuty (Ini)" for the power-supply duty ratio is properly decided.

At a time point t3, at which the deviation between the target cam shaft phase and the actual cam shaft phase becomes smaller than a predetermined value, the feedback control for the phase-change speed is terminated.

The process for the phase control, which is carried out by the ECU 30 (or the ECU 30 and the EDU 31), will be explained with reference to FIGS. 4A and 4B.

Figure 4A:
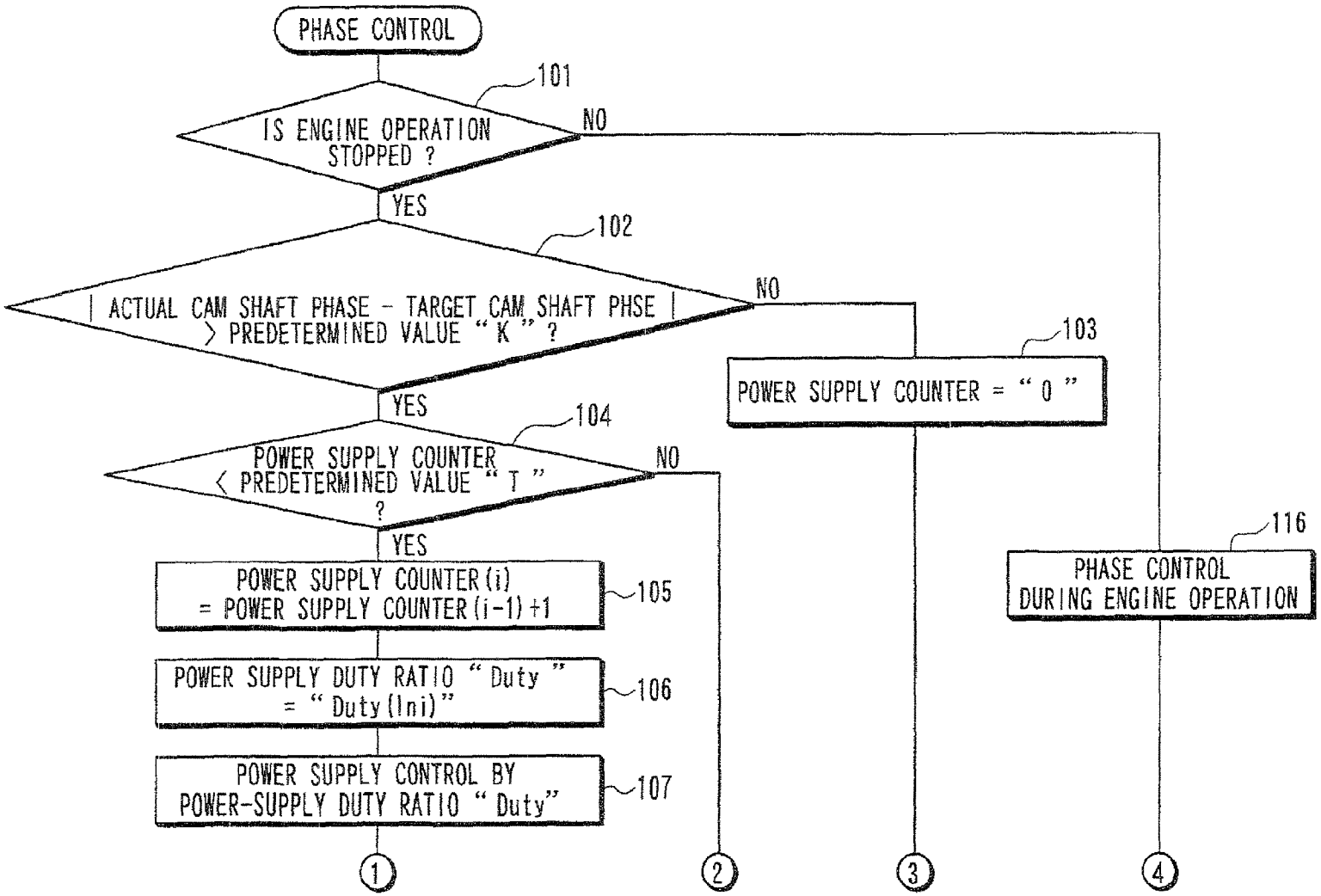
FIG. 4 (FIGS. 4A and 4B) is a flow chart showing a process for the phase control.
Figure 4B:
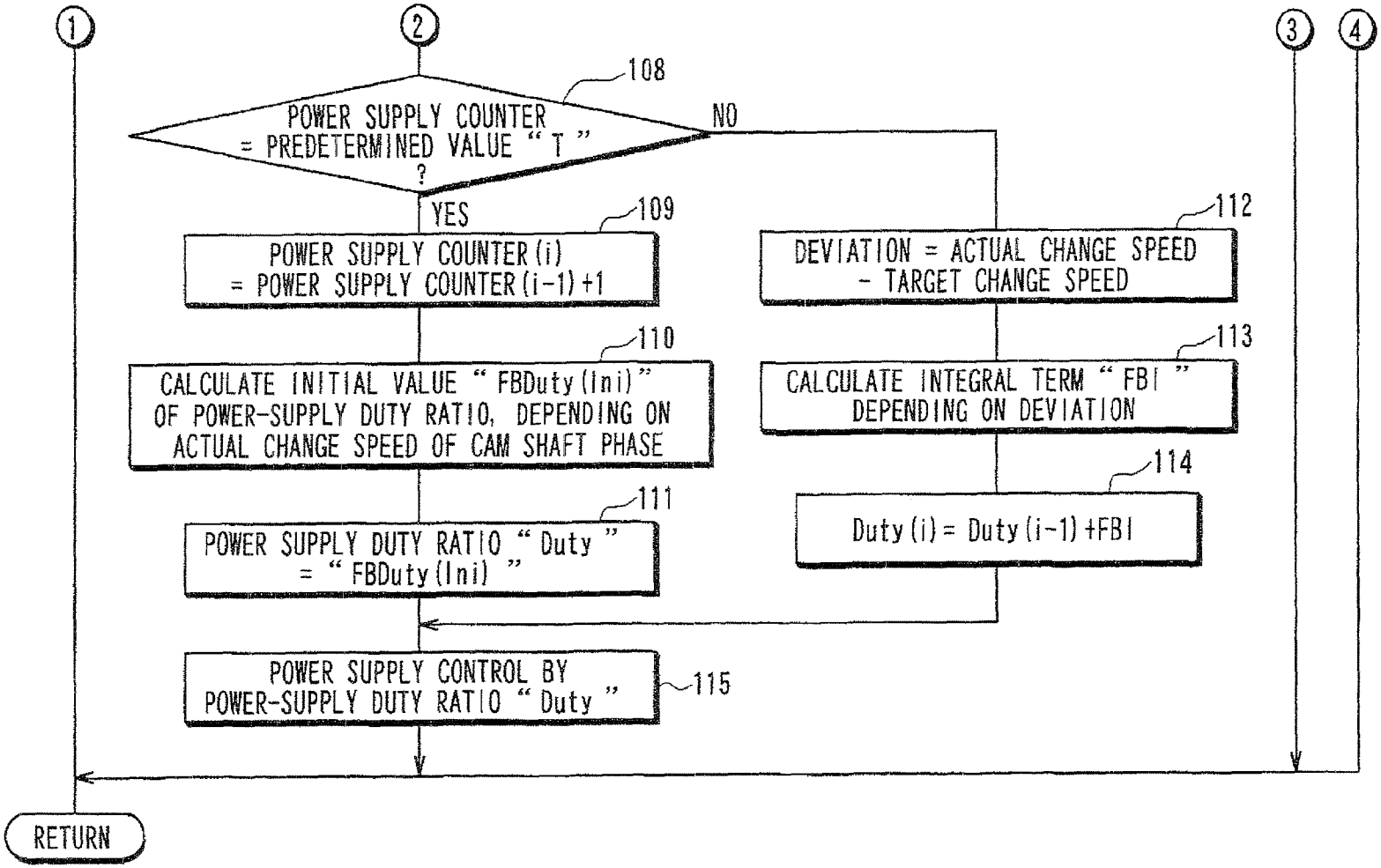

The process for the phase control shown in FIGS. 4A and 4B is repeatedly carried out at a predetermined frequency when the power supply to the ECU 30 is turned on. When the process is started, at a step 101, the ECU 30 determines whether the engine operation is stopped or not (for example, whether engine speed is zero "0" or not).

When the ECU 30 determines at the step 101 that the engine operation is not stopped (that is, the engine is being operated), the process goes to a step 116, at which the phase control for the VVT apparatus 18 during the engine operation is carried out. In the phase control during the engine operation, the ECU 30 calculates the target motor rotational speed, based on the deviation between the target cam shaft phase and the actual camshaft phase and based on the engine rotational speed. The ECU 30 carries out the feedback control for the power-supply duty ratio to the electric motor 26, so that the deviation between the target motor rotational speed and the actual motor rotational speed is made smaller. As a result, the actual cam shaft phase is feedback controlled to be closer to (and finally equal to) the target cam shaft phase.

When, at the step 101, the ECU 30 determines that the engine operation is stopped, the process goes to a step 102, at which the ECU 30 determines whether an absolute figure of a difference between the actual camshaft phase and the target cam shaft phase is larger than a predetermined value "K" or not. During the engine operation is stopped, the actual cam shaft phase is calculated based on such an actual cam shaft phase, which was calculated just before the engine operation is stopped, and based on the output signals from the motor rotational angle sensor 29.

When, at the step 102, the ECU 30 determines that the absolute figure of the difference between the actual cam shaft phase and the target cam shaft phase is smaller than the predetermined value "K" (that is, when the actual cam shaft phase is almost equal to the target cam shaft phase), the process goes to a step 103, at which the ECU 30 resets or maintains a count number of a power supply counter to "0".

When, at the step 102, the ECU 30 determines that the absolute figure of the difference between the actual cam shaft phase and the target cam shaft phase is larger than the predetermined value "K", the process goes to a step 104, at which the ECU 30 determines whether the count number of the power supply counter is smaller than a predetermined value "T" or not.

When, at the step 104, the ECU 30 determines that the count number of the power supply counter is smaller than the predetermined value "T", the power-supply increase control is carried out in the following manner. At first, at a step 105, the count number of the power supply counter is increased by "1". Then, the process goes to a step 106, at which the power-supply duty ratio "Duty" is set to the predetermined power increase amount "Duty(Ini)". Then, the process further goes to a step 107, at which the power supply to the electric motor 26 is carried out at the power-supply duty ratio "Duty" (that is, the duty ratio of "Duty(Ini)").

When, at the step 104, the ECU 30 determines that the count number of the power supply counter is larger than the predetermined value "T", the ECU determines that a predetermined time period has passed over from the start of the power-supply increase control, and the feedback control for the phase-change speed is carried out in the following manner.

Figure 5:
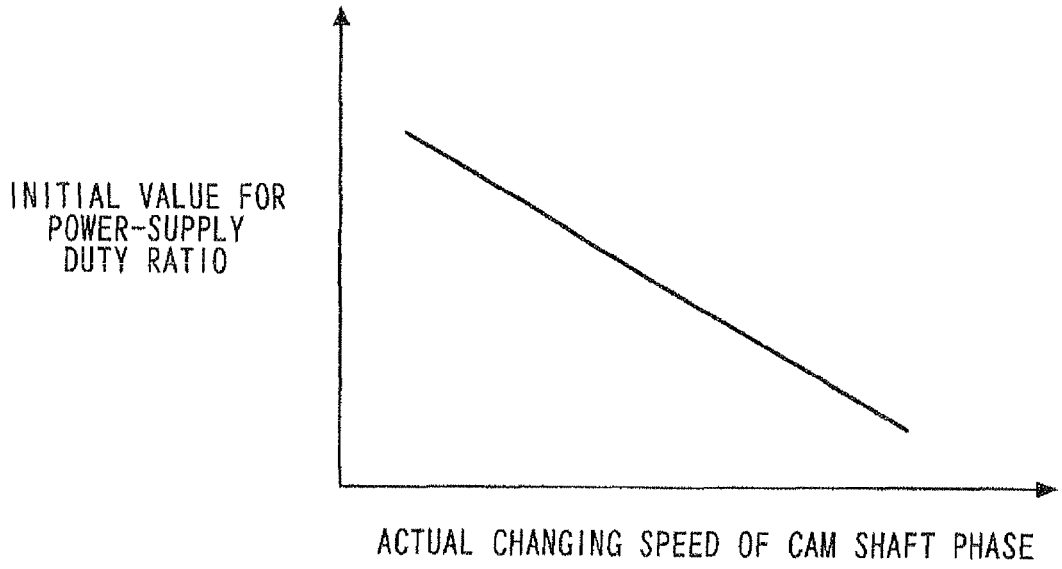
FIG. 5 is a schematic view showing a map of initial values for duty ratio of current supply in a feedback operation for phase-changing speed.

At a step 108 (FIG. 4B), the ECU 30 determines whether the count number of the power supply counter is equal to the predetermined value "T" or not. When the count number of the power supply counter is equal to the predetermined value "T", the process goes to a step 109, at which the count number of the power supply counter is increased by "1". Then, the process goes to a step 110, at which the ECU 30 calculates the initial value "FBDuty(Ini)" of the power-supply duty ratio for the feedback control of the phase-change speed, depending on the actual changing speed of the cam shaft phase during the power-supply increase control. In other words, the initial value "FBDuty(Ini)" of the power-supply duty ratio is calculated based on a map of FIG. 5, which shows a relationship between the initial value "FBDuty(Ini)" of the power-supply duty ratio for the feedback control of the phase-change speed and the actual changing speed of the cam shaft phase.

The actual changing speed of the cam shaft phase during the power-supply increase control is calculated, for example, by a division, wherein a variation for the actual camshaft phase during the power-supply increase control is divided by a running time for the power-supply increase control. According to the map shown in FIG. 5, the initial value "FBDuty (Ini)" of the power-supply duty ratio for the feedback control of the phase-change speed is so set that the initial value "FBDuty(Ini)" becomes larger as the actual changing speed of the cam shaft phase during the power-supply increase control becomes smaller (in other words, as the load torque of the VVT apparatus 18 becomes larger).

Then, the process goes to a step 111, at which the power-supply duty ratio "Duty" is set to the initial value "FBDuty (Ini)". The process further goes to a step 115, at which the power supply to the electric motor 26 is carried out at the power-supply duty ratio "Duty" (that is, the duty ratio of "FBDuty (Ini)").

When, at the step 108, the ECU 30 determines that the count number of the power supply counter is larger than the predetermined value "T", the process goes to a step 112, at which the ECU 30 calculates the deviation between the actual changing speed of the camshaft phase and the target changing speed of the camshaft phase. The above calculating process for the deviation may be simplified by fixing the target changing speed of the cam shaft phase to a predetermined value. Further, the target changing speed of the cam shaft phase may be decided depending on the deviation between the actual cam shaft phase and the target cam shaft phase, wherein the target changing speed of the camshaft phase is made smaller as the deviation between the actual camshaft phase and the target cam shaft phase becomes smaller.

The process further goes to a step 113, at which the ECU 30 calculates the integral term "FBI" for the feedback control of the phase-change speed, depending on the deviation between the actual changing speed and the target changing speed of the cam shaft phase. The integral gain used for calculating the integral term "FBI" is set depending on the actual changing speed of the cam shaft phase during the power-supply increase control. For example, the integral gain is made larger, as the actual changing speed of the cam shaft phase during the power-supply increase control becomes smaller (in other words, as the load torque for the VVT apparatus 18 becomes larger).

The integral gain "FBI" for the feedback control of the phase-change speed may be, alternatively, calculated depending on the deviation between the actual changing speed and the target changing speed of the cam shaft phase and depending on the actual changing speed of the cam shaft phase during the power-supply increase control.

Then, the process goes to a step 114, at which the ECU 30 calculates the power-supply duty ratio "Duty(i)" for the current control cycle by adding the integral term "FBI" to the power-supply duty ratio "Duty(i−1)" for the previous control cycle, as below:

$$\text{"Duty}(i)\text{"}=\text{"Duty}(i-1)\text{"}+\text{"FBI"}$$

Then, the process goes to the step 115, at which the power supply to the electric motor 26 is carried out at the power-supply duty ratio "Duty" (that is, the duty ratio of ["Duty(i−1)"+"FBI"]).

According to the above explained embodiment, when the cam shaft phase is changed during the engine operation is stopped, the power-supply increase control is carried out at starting power supply to the electric motor 26, so that the power-supply duty ratio to the electric motor 26 is increased to the predetermined power increase amount. As a result, the output torque of the electric motor 26 is properly increased in order to drive the VVT apparatus 18, and thereby the cam shaft phase can be surely changed.

In addition, after the power-supply increase control, the ECU 30 further carries out the feedback control for the phase-change speed, according to which the power-supply duty ratio is controlled so that the actual changing speed for the camshaft phase coincides with the target changing speed. Accordingly, the changing speed for the cam shaft phase is prevented from becoming too fast, and the operating sound of the VVT apparatus 18 can be decreased.

Furthermore, according to the present embodiment, during the feedback control for the phase-change speed, the gain for the feedback control for the phase-change speed and the initial value for the power-supply duty ratio are decided depending on the actual changing speed of the cam shaft phase during the power-supply increase control (that is, the parameter accurately reflecting the load torque for the VVT apparatus 18). Therefore, it is possible to change the gain for the feedback control for the phase-change speed and the initial value for the power-supply duty ratio, depending on the load torque for the VVT apparatus 18. In other words, it is possible to properly decide the gain for the feedback control for the phase-change speed and the initial value for the power-supply duty ratio, depending on the load torque for the VVT apparatus 18.

In addition, according to the present embodiment, during the feedback control for the phase-change speed, the power-supply duty ratio is feedback controlled by use of the integral term. As a result, it is possible to effectively make smaller the deviation between actual changing speed and the target changing speed of the cam shaft phase, during the feedback control for the phase-change speed. It is, therefore, possible to stabilize the actual changing speed of the cam shaft phase, in other words, to decrease variation of the actual changing speed.

According to the present embodiment, during the feedback control for the phase-change speed, not only the gain for the feedback control for the phase-change speed but also the initial value for the power-supply duty ratio is decided depending on the actual changing speed of the cam shaft phase during the power-supply increase control. However, either one of the gain for the feedback control for the phase-change speed and the initial value for the power-supply duty ratio may be decided depending on the actual changing speed of the cam shaft phase during the power-supply increase control.

According to the present embodiment, during the feedback control for the phase-change speed, the power-supply duty ratio is feedback controlled by use of the integral term. However, the power-supply duty ratio may be feedback controlled by use of the integral term and a proportional term.

The present invention may not be limited to the variable valve timing apparatus for the intake valve. The present invention may be applied to the VVT apparatus for the exhaust valve. The present invention may not be limited, to the phase variable mechanism shown in FIG. 2. Any other type of the phase variable mechanism, according to which the rotational phase of the cam shaft with respect to the crank shaft is changed by use of the electric motor, may be used for the present invention.

Second Embodiment

Figure 2:
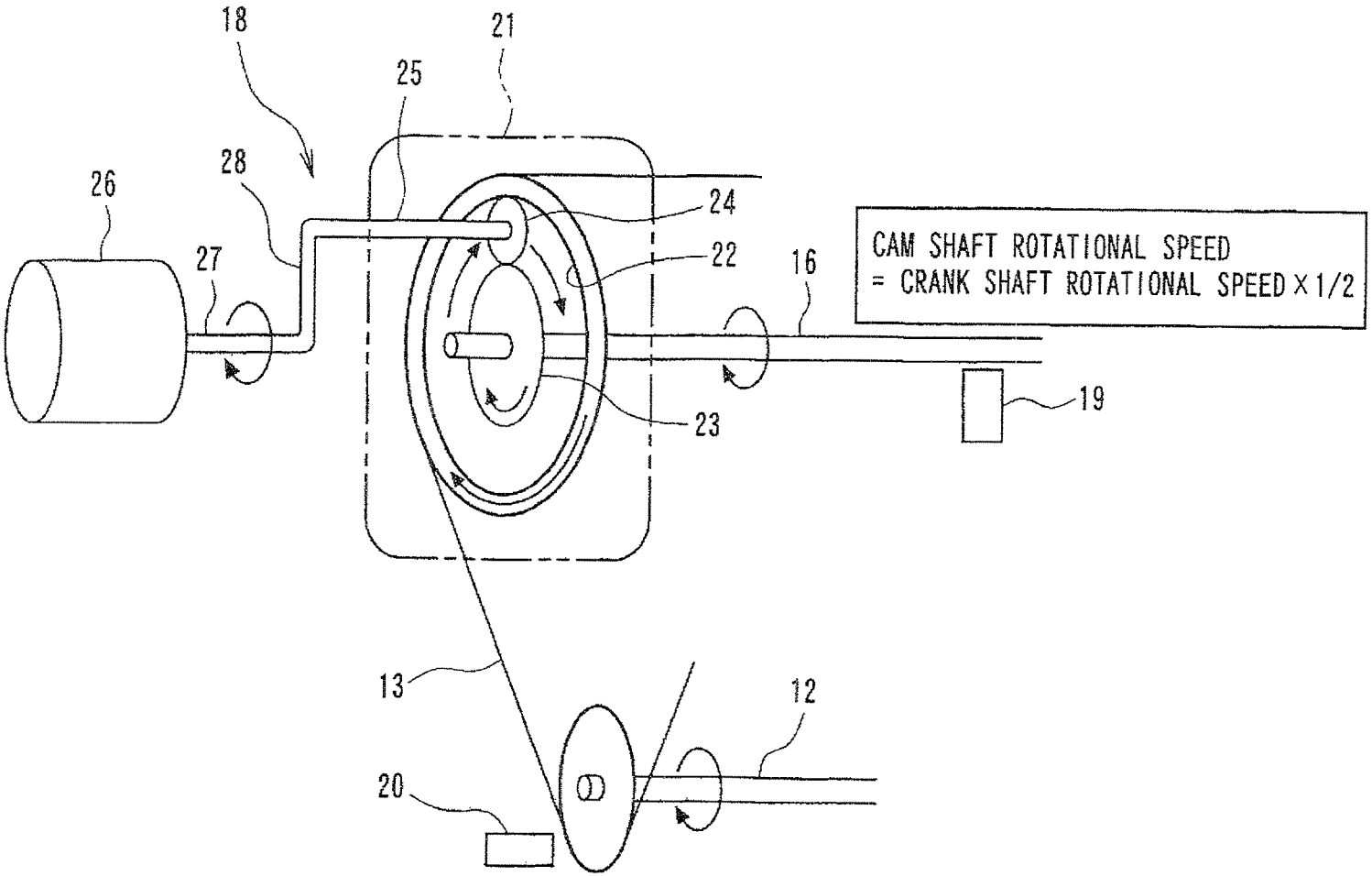
FIG. 2 is a schematic perspective view showing the variable valve timing apparatus.

A second embodiment of the present invention may be applied to the VVT control system shown in FIGS. 1 and 2. Therefore, the second embodiment will be explained with reference to FIGS. 1, 2 and 6A to 8.

An optimum value of the valve timing at starting the engine depends on temperature of the engine 11 (temperature of engine cooling water). More exactly, the optimum value of the valve timing is shifted to an advancing side, as the temperature of the engine cooling water becomes lower. When the engine operation is stopped by turning off the ignition switch, and if the valve timing is not set at a proper value for a next engine starting operation (wherein the proper value depends on the temperature of the engine cooling water at re-starting the engine operation), it may happen that the engine operation may not be smoothly started.

According to the second embodiment, the valve timing is changed not only during the engine is operated but also when the engine operation is stopped by turning off the ignition switch. More exactly, the electric motor 26 is operated after the engine operation is stopped (the ignition switch is turned off), so that the valve timing is set at the proper value, which is suitable for starting the engine operation in a cold weather condition. As a result, it is possible to surely re-start the engine operation.

The actual cam shaft phase after the stop of the engine operation is calculated based on the output signals from the motor rotational angle sensor 29. More exactly, the ECU 30 calculates the actual cam shaft phase, which corresponds to the actual camshaft phase just before the engine operation is stopped, based on the output signals from the motor rotational angle sensor 29 and the crank angle sensor 20. In addition, the ECU 30 calculates an operated amount of the electric motor 26 after the engine operation has been stopped, based on the output signals from the motor rotational angle sensor 29. Then, the ECU 30 calculates the actual cam shaft phase after the stop of the engine operation, based on the actual cam shaft phase just before the stop of the engine operation as well as the operated amount of the electric motor 26 after the stop of the engine operation.

When the valve timing is changed after the stop of the engine operation, it is necessary to rotate the cam shaft 16 from its halt condition by the electric motor 26. Therefore, in the case that the rotational phase of the cam shaft 16 is changed (namely, the valve timing is changed) by the VVT apparatus 18 after the stop of the engine operation, a force (torque) larger than that for rotating the cam shaft 16 during the engine operation may be necessary due to influences of gear engagement of the phase variable mechanism 21 and/or valve springs. Accordingly, when the rotational phase (the valve timing) is changed after the stop of the engine operation, a locked condition (the change of the rotational phase of the cam shaft 16 with respect to the crank shaft 12 is stopped during the phase changing operation) may occur.

More exactly, each of the gear members of the phase variable mechanism 21 (such as, the outer gear member 22, the inner gear member 23, and the planet gear member 24) may include asymmetry, which is caused by errors in manufacturing processes and/or heat treatment. As a result, gear engagement between the neighboring gear members may not be in a good condition due to such asymmetry and thereby the rotational force of the electric motor 26 may not be smoothly transmitted to the cam shaft 16. In such a case, the output torque of the electric motor 26 may come short for rotating the cam shaft 16, and thereby the locked condition may occur.

When the cam shaft 16 is rotated by the VVT apparatus 18 with respect to the crank shaft 12, the intake valve is displaced against the spring force of the valve spring. Namely, it is necessary in some cases that a cam follower climbs over a cam nose of a cam provided on the cam shaft 16. When the engine operation is stopped, the rotation of the crank shaft 12 is stopped. Therefore, a load for compressing the valve spring becomes larger when compared with that during the engine operation. When the cam follower can not climb over the cam nose, the change of the rotational phase of the cam shaft 16 with respect to the crank shaft 12 is stopped to thereby cause the locked condition. When the locked condition of the cam shaft 16 (for the intake valve) occurs due to various reasons, it is not possible to change the valve timing at a desired timing (for example, which is suitable for starting the engine in the cold weather condition). As a result, a performance for starting the engine may be decreased.

According to the present embodiment, therefore, the ECU 30 detects whether the locked condition has occurred at the camshaft 16 or not, when the valve timing is controlled (changed) after the engine operation is stopped. The locked condition is defined as such a condition, in which the change of the rotational phase of the cam shaft 16 (e.g. for the intake valve) is stepped on the way to a target rotational phase (a target cam shaft phase). In the case that the locked condition for the cam shaft 16 is detected, a lock releasing control is carried out, according to which the cam shaft phase is temporarily controlled in a reversed direction, which is a direction opposite to the direction for changing the actual camshaft phase to the target camshaft phase. Then, the camshaft phase is once again controlled in the initial direction to the target cam shaft phase after the lock releasing control. More exactly, when the locked condition for the cam shaft 16 is detected, the direction of the power supply to the electric motor 26 is reversed to thereby temporarily rotate the cam shaft 16 in the reversed direction, and then the power supply to the electric motor 26 is restored to its initial direction, so that the locked condition is surely released.

Figure 6A:
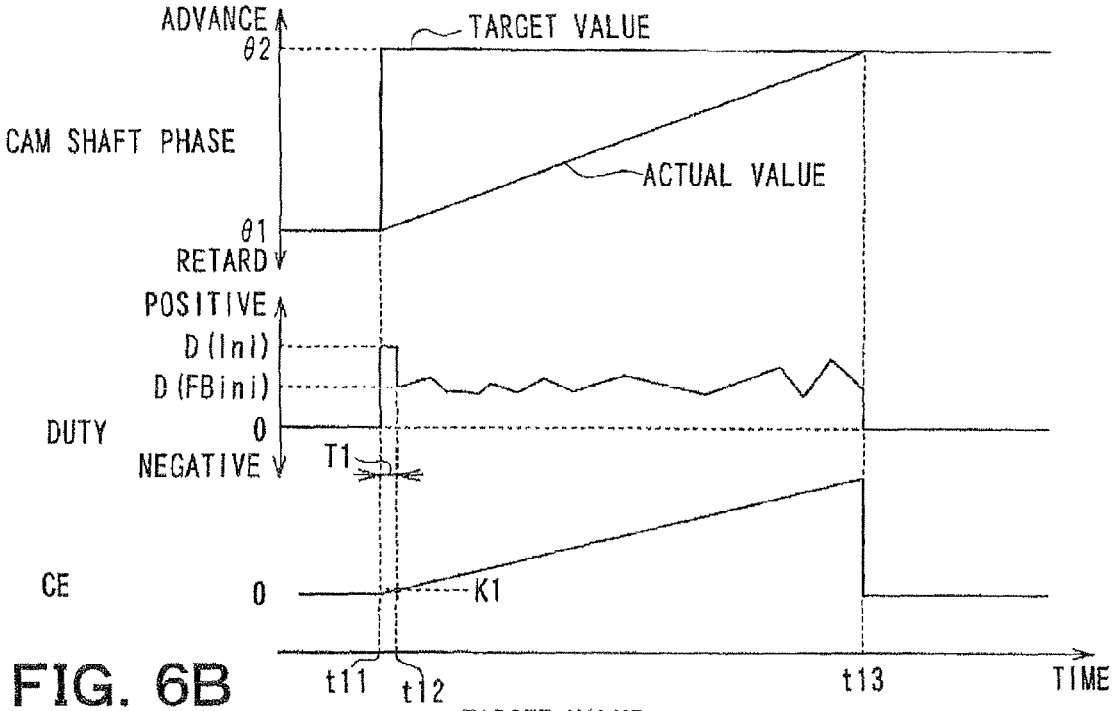
FIGS. 6A and 6B are timing charts for explaining an example of carrying out phase control during engine operation is stopped according to a second embodiment of the present invention.
Figure 6B:
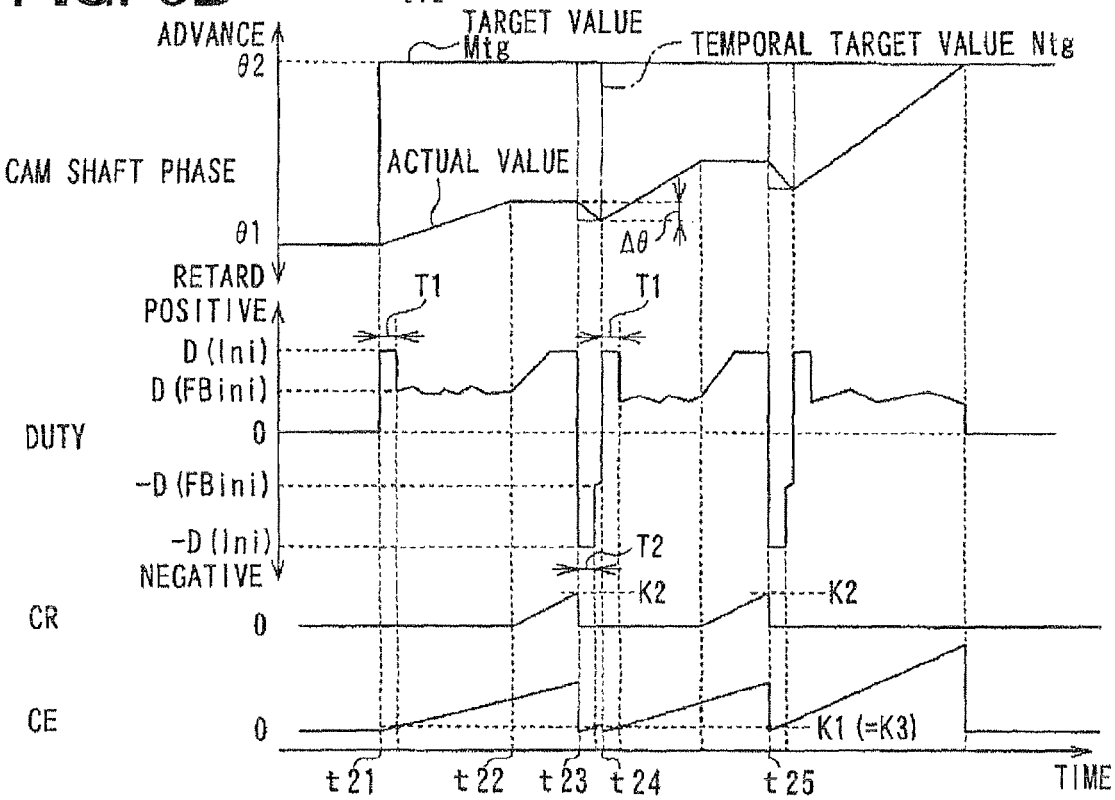

FIGS. 6A and 6B are timing charts for the valve timing control after the stop of the engine operation. FIG. 6A shows the valve timing control in a normal condition for the cam shaft 16, wherein the locked condition does not occur when changing the cam shaft phase. FIG. 6B shows the valve timing control when the locked condition has occurred at the cam shaft 16 on the way of changing the cam shaft phase to the target cam shaft phase.

According to the present embodiment, as shown in FIGS. 6A and 6B, the cam shaft phase is set at a most retarded position "θ1", when the engine operation is stopped. When the cam shaft phase is changed to a most appropriate position "θ2" suitable for smoothly starting the engine in the cold weather (which is on an advanced side by 50 to 70° CA from the most retarded position "θ1"), a power-supply increase control is carried out at a time point t11. At the same time, a counting process is started at a power supply counter CE in accordance with the power supply to the electric motor 26.

During the power-supply increase control, a power-supply duty ratio "Duty" to the electric motor 26 is set at a power increase value "D(Ini)". As in the same manner to the first embodiment, the feedback control is carried out at a time point t12 after the power-supply increase control. The power increase value "D(Ini)" is set at such a value, which is larger than a control value for the feedback control. More exactly, the power increase value "D(Ini)" is set at a duty ratio higher than a ratio of 80%, so that the electric motor 26 outputs a torque necessary for overcoming the static friction forces of respective portions of the cam shaft 16 and the VVT apparatus 18 in order that the cam shaft 16 can be rotated.

When a predetermined time period T1 passes over from the start (t11) of the power-supply increase control, namely at the time point t12, a value (a counted number) of the power supply counter CE reaches at a predetermined threshold value "K1". Then, the feedback control for the power-supply duty ratio is started for the electric motor 26, so that the actual cam shaft phase becomes closer to (and finally equal to) the target cam shaft phase. More exactly, the power-supply duty ratio is set at an initial value "D(FBini)" at the time point t12, and then the feedback control is carried out, for example, by use of an integral term. At a time point t13, when the actual cam shaft phase reaches at the target cam shaft phase, the feedback control for the power-supply duty ratio is stopped so as to cut off the power supply to the electric motor 26.

A case, in which the locked condition has occurred at the cam shaft 16 during the operation for changing the cam shaft phase to the target cam shaft phase, will be explained with reference to FIG. 6B. At a time point t21, the power supply to the electric motor 26 is started and then the feedback control for the power-supply duty ratio is carried out after the time period T1. When the locked condition occurs at a time point t22 during the feedback control for the power-supply duty ratio, the cam shaft phase can no longer be changed. A lock counter CR starts counting of time at the time point t22. When the value (the counted number) of the lock counter CR reaches at a threshold value K2 at a time point t23, a direction of the power supply to the electric motor 26 is reversed so as to change the cam shaft phase in a direction opposite to the target cam shaft phase.

More exactly, according to the present embodiment, a target value for the cam shaft phase has a final target value "Mtg" and a temporal target value "Ntg", which is used for each control cycle of the process repeated at a predetermined cycle. In the normal operating condition, in which no locked condition occurs, the final target value "Mtg" (a solid line in FIG. 6B) is used as the temporal target value "Ntg". When the locked condition has occurred, the cam shaft phase is controlled based on the temporal target value "Ntg" (a one-dot-chain line in FIG. 6B). According to the present embodiment, the temporal target value "Ntg" is set at such a value, which is smaller than the cam shaft phase at the locked condition (t23) by a predetermined phase-changing value "Δθ" (for example, 10° CA). Namely, the temporal target value "Ntg" is set at the value on a retarding side by the predetermined phase-changing value "Δθ". In a subsequent control period after the time point t23 (at which the above temporal target value "Ntg" has been set), the power-supply duty ratio is changed to a predetermined negative value (for example, "−D(Ini)"), in order that the actual cam shaft phase is controlled to be closer to (and finally equal to) the temporal target value "Ntg".

During the above control period for the temporal target value "Ntg", the power-supply duty ratio is maintained, at the predetermined negative value ("−D(Ini)") in FIG. 6B) for a predetermined time period T2, and then the feedback control for the power-supply duty ratio is carried out. More exactly, the power supply counter CE is reset to zero at the time point t23 so as to re-start the counting of the time. When the value (the counted number) of the power supply counter CE reaches at a predetermined threshold value K3, the feedback control for the power-supply duty ratio is carried out (according to the present embodiment, K3=K1).

According to the present embodiment, the predetermined negative value ("−D(Ini)") is set at such a value on the negative side, which is larger than a control amount during the feedback control. The predetermined time period T2 may be the same to (or different from) the time period T1 for the power-supply increase control (the target value for which is "Mtg").

When the actual cam shaft phase reaches at the temporal target value "Ntg" at a time point t24, the target value is changed from the temporal target value "Ntg" to the final target value "Mtg". At the same time, the power-supply duty ratio to the electric motor 26 is changed to the positive value of "D(Ini)", which is maintained during the predetermined time period T1.

As above, when the locked condition occurs at the cam shaft 16, the rotational direction of the cam shaft 16 is temporarily reversed in a backward direction, and then the rotational direction is changed again at a rash to the (forward) direction of the target value "Mtg". According to the present embodiment, a momentum is given to the rotation of the cam shaft 16 by reversing the rotational direction (from the backward to the forward direction), so that the locked condition of the cam shaft 16 is released.

After the locked condition has been released as above but when another locked condition occurs at a time point t25 during the operation for controlling the actual cam shaft phase to the target value, the target value is changed again to the temporal target value "Ntg" and the power-supply duty ratio is also changed to the predetermined negative value ("−D(Ini)"). Then, the rotational direction of the cam shaft 16 is changed from the backward to the forward direction in order that the momentum is given to the rotation of the cam shaft 16 to thereby release the locked condition. As above, when the locked condition occurs during the operation for controlling the cam shaft phase to the target value, the lock releasing control is carried out several times so that the cam shaft phase is finally controlled at the final target value "Mtg".

FIGS. 6A and 6B show the timing charts for the case, in which the final target value "Mtg" is located on the advancing side with respect to the cam shaft phase at the stop of the engine operation. Namely, FIGS. 6A and 6B show the timing charts for the case in which the cam shaft phase is changed from the retarding side to the advancing side. The present invention may be also applied to a case, in which the final target value "Mtg" is located on the retarding side with respect to the cam shaft phase at the stop of the engine operation, namely applied to the case in which the cam shaft phase is changed from the advancing side to the retarding side. In such a case, the temporal target value "Ntg" may be set at such a value, which is larger than the cam shaft phase at the locked condition by the predetermined phase-changing value "Δθ" (for example, 10° CA). Namely, the temporal target value. "Ntg" is set at the value on the advancing side by the predetermined phase-changing value "Δθ".

Figure 7A:
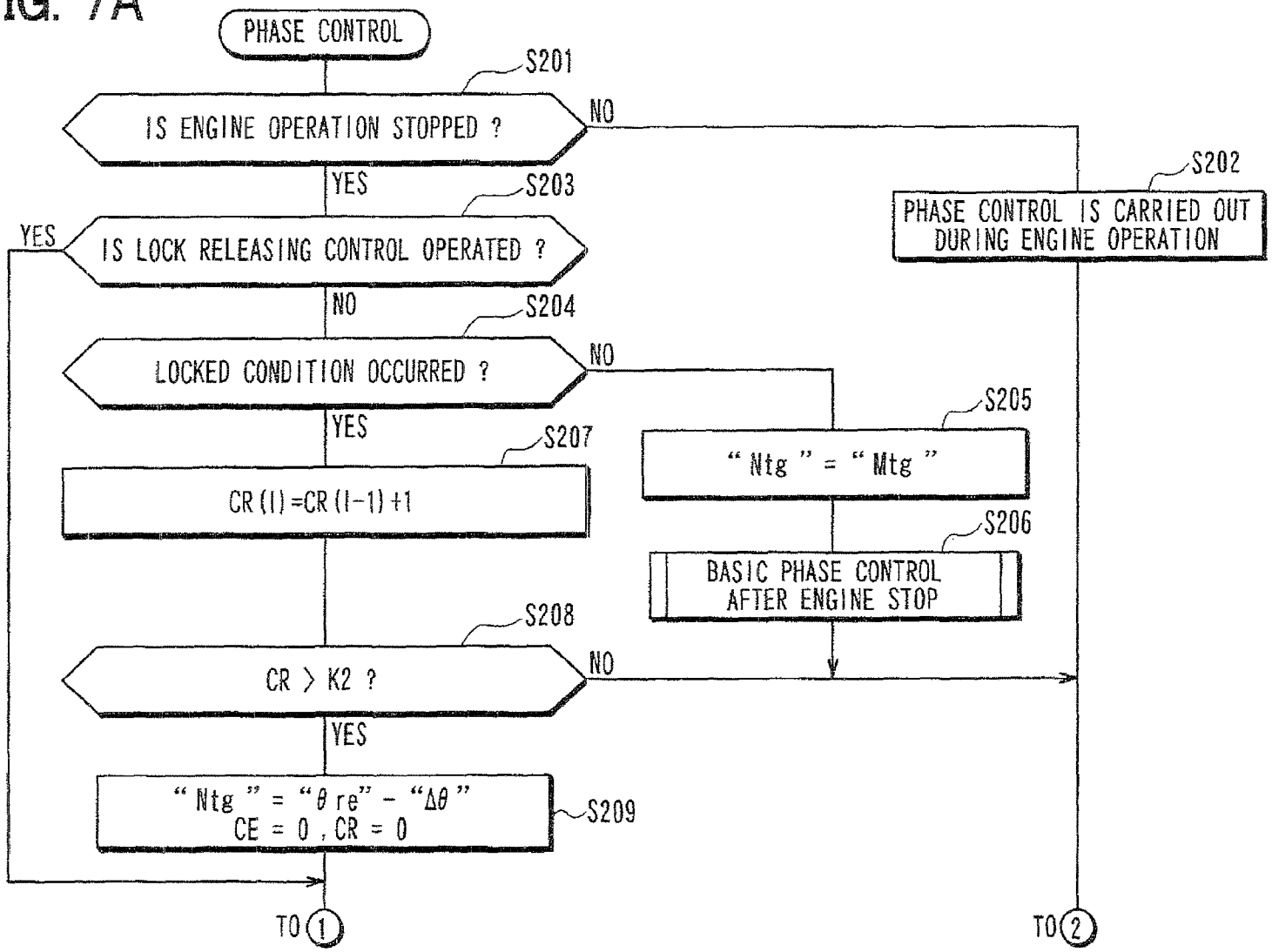
FIG. 7 (FIGS. 7A and 7B) is a flow chart showing a process for the phase control of the second embodiment.
Figure 7B:
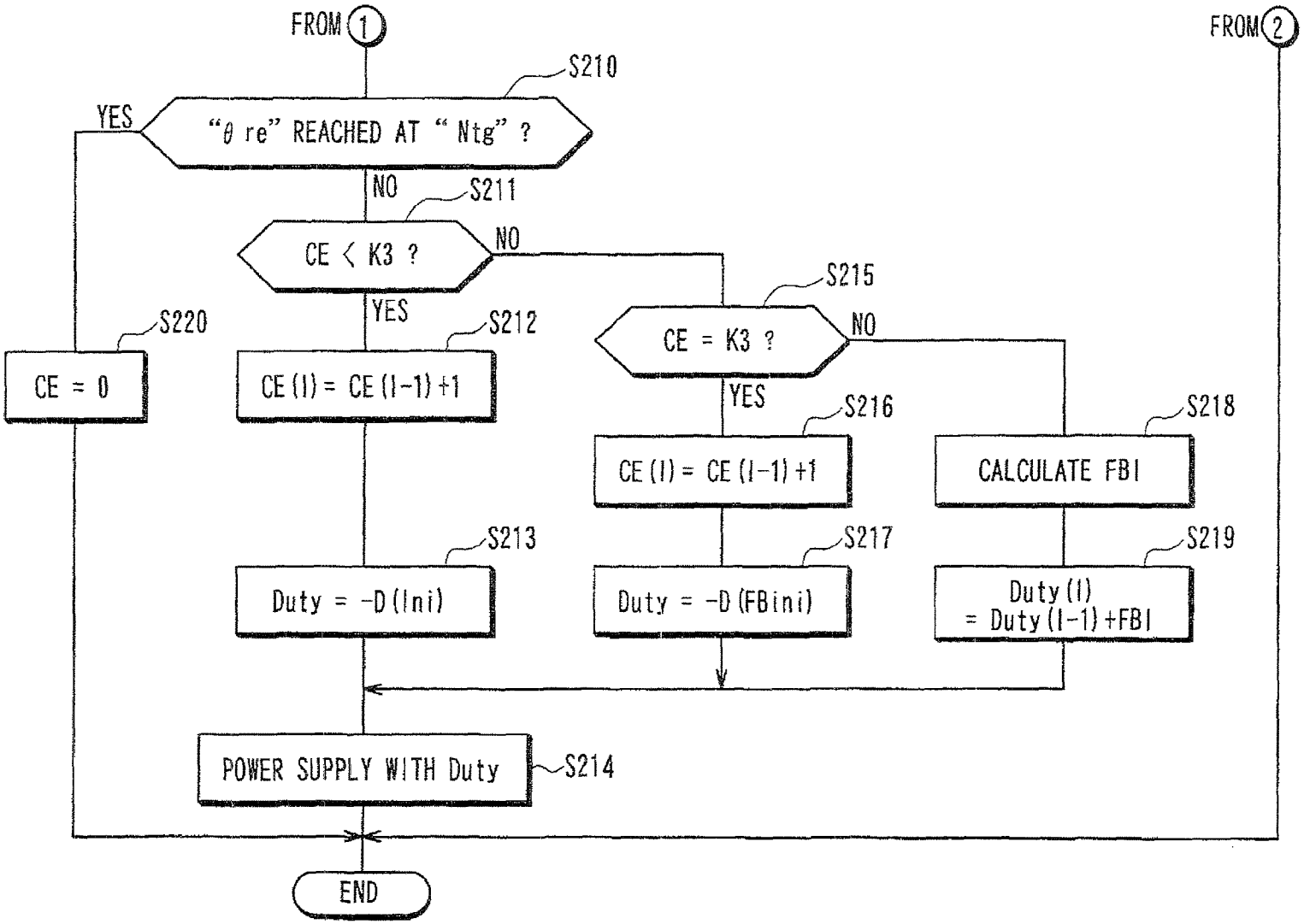

The phase control for the cam shaft 16 (of the intake valve) will be explained with reference to flowcharts shown in FIGS. 7A and 7B. The processes of FIGS. 7A and 7B are repeated by the ECU 30 at a predetermined cycle. According to the present embodiment, the electrical power is supplied to the ECU 30 and the electric motor 26 by turning on a main relay of a power line even after the ignition switch (not shown) is turned off.

At a step S201 of FIG. 7A, the ECU 30 determines whether the engine operation is stopped or not. When the engine is operated, the process goes to a step S202, at which a phase control for the engine operation is carried out. In the phase control during the engine operation, a target motor speed is calculated based on a deviation between the target value "Mtg" and the actual cam shaft phase "θre" as well as engine rotational speed. Then, the power-supply duty ratio to the electric motor 26 is feedback controlled based on a deviation between the target motor speed and an actual motor speed.

When the engine operation is stopped, the process goes to a step S203, at which the ECU 30 determines whether the lock releasing control (for releasing the locked condition at the cam shaft 16) is being carried out or not. In the case that the lock releasing control is not being carried out, the process goes to a step S204, at which the ECU 30 determines whether the locked condition has occurred or not at the cam shaft 16.

According to the present embodiment, the determination whether the locked condition has occurred at the cam shaft 16 or not is done based on an output signal from the motor rotational angle sensor 29. More exactly, the ECU 30 calculates rotational variation (changing speed of the cam shaft phase) of the electric motor 26 based on the output of the motor rotational angle sensor 29. Then, the ECU 30 determines that the locked condition (in which the changing speed of the cam shaft phase is almost or substantially stopped) has occurred when such calculated rotational variation is smaller than a predetermined value.

When it is in a condition that the feedback control is being carried out for the power-supply duty ratio to the electric motor 26, a gain for an integral term "FBI" is changeable in accordance with the changing speed of the cam shaft phase. Then, the ECU 30 may determine the locked condition based on the gain.

When the ECU 30 determines that the locked condition has not occurred at the cam shaft 16, the process goes to a step S205, at which the temporal target value "Ntg" for the cam shaft phase is set at the target value "Mtg". At a step S206, a basic phase control after the stop of the engine operation is carried out.

Figure 8:
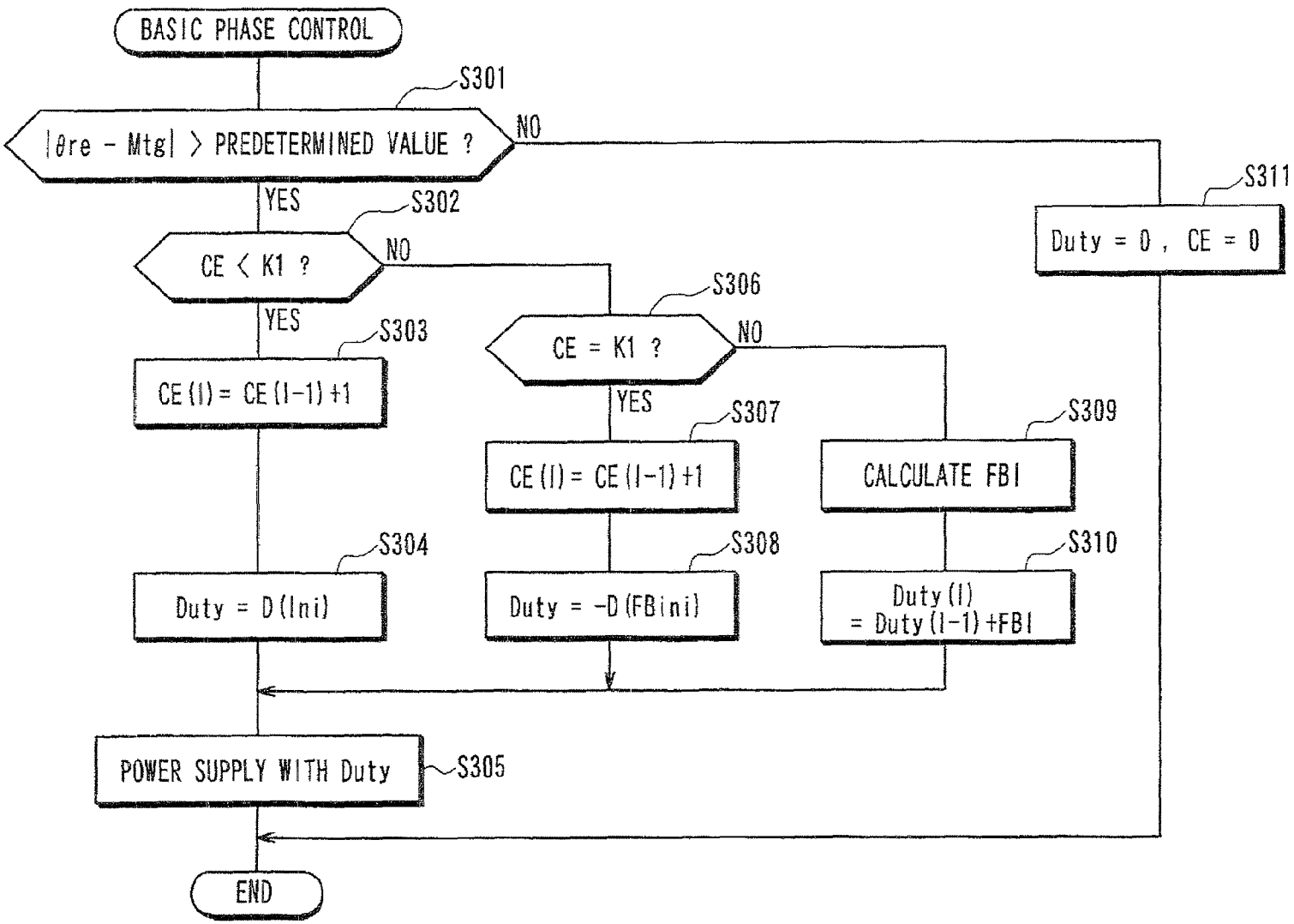
FIG. 8 is a flow chart showing a detailed, process for a basic phase control, which is carried out at a step S206 of FIG. 7A.

FIG. 8 shows a process of the basic phase control for the cam shaft 16 after the stop of the engine operation. At a step S301, the ECU 30 calculates the actual cam shaft phase "θre" shortly after the stop of the engine operation, based on the actual cam shaft phase shortly before the stop of the engine operation as well as a rotational operated amount of the cam shaft 16 after the stop of the engine operation (which is calculated based on the output from the motor rotational angle sensor 29). Then, the ECU 30 determines whether an absolute figure of a difference between the actual cam shaft phase "θre" and the target value "Mtg" is larger than a predetermined value or not.

When the absolute figure of the difference between the actual cam shaft phase "θre" and the target value "Mtg" is larger than the predetermined value, the process goes to a step S302, at which the ECU 30 determines whether the value (the counted number) of the power supply counter CE is smaller than the threshold value "K1". When the value of the power supply counter CE is smaller than the threshold value "K1", the process goes to steps S303 to S305, at which the power-supply increase control is carried out.

At the step S303, the power supply counter CE is counted up by a predetermined value (according to the present embodiment, the predetermined value is "1"). At the step S304, the power-supply duty ratio "Duty" is set at the power increase value "D(Ini)". Then, at the step S305, a command is outputted to the EDU 31 so that the power supply control to the electric motor 26 is carried out with the power-supply duty ratio "Duty" (=the power increase value "D(Ini)").

When the value (the counted number) of the power supply counter CE is not less than the threshold value "K1", the process goes to a step S306, at which the ECU 30 determines whether the value of the power supply counter CE is equal to the threshold value "K1". When the value of the power supply counter CE is equal to the threshold value "K1", the process goes to a step S307, at which the ECU 30 determines that the predetermined time period "T1" has passed over since the start of the power-supply increase control. And the power-supply increase control is changed to the feedback control.

More exactly, at the step S307, the power supply counter CE is counted up by one "1", and at the step S308, the power-supply duty ratio "Duty" for the feedback control is set at the initial value "D(FBini)". According to the present embodiment, the initial value "D(FBini)" is set depending on the actual changing speed of the cam shaft phase during the power-supply increase control. More exactly, the initial value "D(FBini)" is set at a larger value, as the actual changing speed of the cam shaft phase is smaller during the power-supply increase control (in other words, as the load torque for the VVT apparatus 18 becomes larger). The changing speed of the cam shaft phase during the power-supply increase control can be calculated, for example, by dividing the changing amount of the actual cam shaft phase during the power-supply increase control by a time for the power-supply increase control. Then, the process goes to the step S305, at which the command is outputted to the EDU 31 so that the power supply control to the electric motor 26 is carried out with the power-supply duty ratio "Duty" (=the initial value "D(FBini)").

When the value (the counted number) of the power supply counter CE is larger than the threshold value "K1" (NO at the step S306), the process goes to a step S309 in order to calculate a deviation between the actual changing speed and the target changing speed of the cam shaft phase. The integral term "FBI" for the feedback control is calculated depending on the calculated deviation. According to the present embodiment, the integral gain used for calculating the integral term "FBI" is set depending on the actual changing speed of the cam shaft phase during the power-supply increase control. The integral gain is set at a larger value, as the actual changing speed of the cam shaft phase is smaller during the power-supply increase control (in other words, as the load torque for the VVT apparatus 18 becomes larger).

In case of calculating the deviation between the actual changing speed and the target changing speed of the camshaft phase, the target changing speed of the cam shaft phase may be fixed at a predetermined value, so that the calculation for the deviation may be simplified. Alternatively, the target changing speed of the cam shaft phase may be set depending on the deviation between the actual cam shaft phase and the target cam shaft phase. In such a case, the target changing speed of the cam shaft phase may be set at a smaller value, as the deviation between the actual cam shaft phase and the target camshaft phase becomes smaller. In addition, in case of calculating the integral term "FBI", the integral term "FBI" may be calculated depending on the deviation between the actual changing speed and the target changing speed of the cam shaft phase as well, as on the actual changing speed of the cam shaft phase during the power-supply increase control.

At a step S310, the power-supply duty ratio "Duty(I)" of this control cycle is calculated by adding the integral term "FBI" to the power-supply duty ratio "Duty(I−1)" of the previous control cycle. Then, the process goes to the step S305, so that the command is outputted to the EDU 31 in order that the power supply control to the electric motor 26 is carried out with the power-supply duty ratio "Duty" (="Duty (I)").

When the absolute figure of the difference between the actual cam shaft phase "θre" and the target value "Mtg" becomes smaller than the predetermined value, namely when NO at the step S301, the process goes to a step S311. At the step S311, the power-supply duty ratio to the electric motor 26 is set at zero "0", and the power supply counter CE is reset to zero "0". As a result, the cam shaft phase is finally controlled to coincide with the target value.

Referring back to the flowcharts of FIGS. 7A and 7B, when the locked condition (in which the camshaft 16 can no longer be rotated in the direction to the target value "Mtg") occurs during the operation for controlling the cam shaft phase to the target value "Mtg", the determination at the step S204 becomes YES and the process goes to a step S207. At the step S207, the lock counter CR is counted up by one "1", and at a step S208 the ECU 30 determines whether the value (the counted number) of the lock counter CR is larger than the threshold value "K2" or not.

When the value (the counted number) of the lock counter CR is not larger than the threshold value "K2", the process is ended. On the other hand, when the value of the lock counter CR becomes larger than the threshold value "K2", the process goes to a step S209. At the step S209, the ECU 30 sets the temporal target value "Ntg" at a value ("θre"−"Δθ"), which is displaced from the actual cam shaft phase "θre" by the phase-changing value "Δθ" (for example, 10° CA) in the direction opposite to the direction to the target value "Mtg". At the same time, the ECU 30 resets the power supply counter CE and the lock counter CR to zero "0".

In FIGS. 7A and 72, the cam shaft phase is shown on the basis of the target value "Mtg", wherein the direction away from the target value "Mtg" is indicated by a negative sign, while the direction closer to the target value "Mtg" is indicated by a positive sign. Therefore, in the case that the target value "Mtg" is on the advancing side with respect to the cam shaft phase shortly after the stop of the engine operation, the mathematical expression in the step S209 (the temporal target value "Ntg"=the actual cam shaft phase "θre"—the phase-changing value "Δθ") means that the temporal target value "Ntg" is set on the retarding side from the actual cam shaft phase "θre" by the phase-changing value "Δθ". On the other hand, in the case that the target value "Mtg" is on the retarding side with respect to the cam shaft phase shortly after the stop of the engine operation, the temporal target value "Ntg" is set on the advancing side from the actual cam shaft phase "θre" by the phase-changing value "Δθ".

At a step S210, the ECU 30 determines whether the actual cam shaft phase "θre" reaches at the temporal target value "Ntg" or not. When the actual cam shaft phase "θre" does not reach at the temporal target value "Ntg", the process goes to a step S211, at which the ECU 30 determines whether the value (the counted number) of the power supply counter CE is smaller than the threshold value "K3". When the value of the power supply counter CE is smaller than the threshold value "K3", the process goes to a step S212.

At the step S212, the value (the counted number) of the power supply counter CE is counted up by a predetermined value (according to the present embodiment, the predetermined value is one "1"). At a step S213, the sign for the power-supply duty ratio "Duty" is reversed, so that the direction of the power supply to the electric motor 26 is set to the direction which is opposite to the direction for controlling the actual cam shaft phase "θre" to the target value "Mtg". Namely, the power-supply duty ratio "Duty" is set to "−D(Ini)", which has the same value "D(Ini)" for the power-supply increase control but has the negative sign. The power-supply duty ratio "Duty" may be alternatively set at a fixed amount. Then, the process goes to a step S214, so that the command is outputted to the EDU 31 in order that the power supply control to the electric motor 26 is carried out with the power-supply duty ratio "Duty" (="−D(Ini)").

When the value (the counted number) of the power supply counter CE is not smaller than the threshold value "K3", the process goes to a step S215, at which the ECU 30 determines whether the value of the power supply counter CE is equal to the threshold value "K3". When the value of the power supply counter CE is equal to the threshold value "K3", the process goes to a step S216. And the power-supply increase control is changed to the feedback control. More exactly, at the step S216, the power supply counter CE is counted up by one "1", and at the step S217, the power-supply duty ratio "Duty" for the feedback control is set at the initial value "−D(FBini)", which has the same value "D(FBini)" for the power-supply increase control but has the negative sign. The power-supply duty ratio "Duty" may be alternatively set at a fixed amount. Then, the process goes to the step S214, so that the command is outputted to the EDU 31 in order that the power supply control to the electric motor 26 is carried out with the power-supply duty ratio "Duty" (="−D(FBini)").

When the value (the counted number) of the power supply counter CE is larger than the threshold value "K3", the process goes to a step S218 in order to calculate an integral term "FBI" for the feedback control. According to the present embodiment, the integral term "FBI" is calculated in the same manner to that for the feedback control following the power-supply increase control.

At a step S219, the power-supply duty ratio "Duty(I)" of this control cycle is calculated by adding the integral term "FBI" to the power-supply duty ratio "Duty(I−1)" of the previous control cycle. Then, the process goes to the step S214, so that the command is outputted to the EDU 31 in order that the power supply control to the electric motor 26 is carried out with the power-supply duty ratio "Duty" (="Duty (I)").

According to the present embodiment, the invention has the following advantages.

According to the present embodiment, the ECU 30 detects whether the locked condition (in which the cam shaft phase can not be changed any longer during the operation for controlling the actual cam shaft phase to the target cam shaft phase) has occurred at the cam shaft 16 during the valve timing control after the stop of the engine operation. When the locked condition is detected, the cam shaft phase is temporarily controlled in the direction opposite to the direction of the operation for controlling the actual camshaft phase to the target cam shaft phase. More exactly, the direction of the power supply to the electric motor 26 is reversed, so that the rotation of the camshaft 16 is temporarily reversed to thereby carry out the lock releasing control. Then, when the cam shaft 16 is rotated again in the direction for controlling the actual cam shaft phase to the target cam shaft phase, the momentum is given to the rotation of the cam shaft 16 so as to release the locked condition. As a result, it is possible to surely change the actual cam shaft phase of the cam shaft 16 to the target value, so that the valve timing control can be properly carried out.

In addition, when the rotation of the cam shaft 16 is restored to its original rotational direction after the rotational direction is temporarily reversed, the power-supply duty ratio to the electric motor 26 is temporarily set at the power increase value "D(Ind.)" during the initial stage. As a result, the output torque of the electric motor 26 is properly and instantly increased, when the rotation of the cam shaft 16 is changed from the reversed direction to the forward direction. Therefore, the locked condition can be surely released.

Other Embodiments

The present invention should not be limited to the above explained embodiments, but may be modified in various ways as below.

(1) When the locked condition for the cam shaft 16 is detected, the lock releasing control may be carried out, in which the phase-changing value "Δθ" for the cam shaft phase is set as a variable amount. More exactly, the power supply amount to the electric motor 26 may be changed depending on a number of executions of the lock releasing control after the stop of the engine operation. For example, the lock releasing control may be carried out with a first power supply amount "D1" for the occurrence of the locked condition for the first time, and then the lock releasing control may be further carried out with a second power supply amount "D2" if the locked condition has occurred at the second time, wherein the second power supply amount "D2" is larger than the first power supply amount "D1". As above, the power supply amount to the electric motor for the lock releasing control is set at a smaller amount for the first time, and then the power supply amount to the electric motor may be gradually increased. As a result, it is possible not only to properly carry out the lock releasing control but also to suppress excessive power supply to the electric motor 26. Therefore, it is possible to reduce the electric power consumption.

Alternatively, a reversing time period, during which the direction of the power supply to the electric motor 26 is temporarily reversed, may be changed. More exactly, the reversing time period may be changed depending on the number of executions of the lock releasing control after the stop of the engine operation. For example, the reversing time period for the lock releasing controls for the second and subsequent times may be made longer than that for the lock releasing control for the first time. As a result, it is possible to make longer the reversing time period for the power supply for releasing the locked condition. Therefore, it is possible not only to properly carry out the lock releasing control but also to suppress excessive power supply to the electric motor 26.

(2) According to the above embodiments, the direction of the power supply to the electric motor 26 is temporarily reversed during the operation for controlling the cam shaft phase to the target value. Namely, the direction for controlling the cam shaft phase is temporarily reversed. However, it may be modified in such a way that the power supply amount to the electric motor 26 may be decreased or made zero while the direction of the power supply is kept as it is. As a result, the cam shaft phase may be also temporarily changed in the reversed direction.

When the cam shaft phase is to be kept at a position on the way for changing the cam shaft phase by the power supply to the electric motor 26, it is necessary to continuously supply the electric power (holding current) to the electric motor. Therefore, when the power supply amount is decreased to a value smaller than the current power supply amount (the holding current), it becomes possible to reverse the phase-changing direction of the cam shaft phase to the opposite direction to that for changing the cam shaft phase to the target value. According to this modification, although the reliability for releasing the locked condition may be decreased when compared with the case in which the direction of the power supply to the electric motor 26 is reversed, slapping sound between gears caused by the reversed rotation of the cam shaft 16 may be decreased.

(3) When the locked condition has occurred at the cam shaft 16 for the first time, the power supply amount to the electric motor 26 may be decreased or the power supply amount to the electric motor 26 may be made zero while keeping the direction of the power supply, so that the locked condition may be released by temporarily reversing the phase-changing direction of the cam shaft phase, as in the same or similar manner to the above modification (2). And when the locked condition may occur again as the second time, the locked condition may be released by temporarily reversing the direction of the power supply to the electric motor 26. According to such a modification, it is possible to keep a balance between the performance for suppressing the generation of the slapping sound between the gears and the reliability for releasing the locked condition.

Namely, when the locked condition has occurred, the direction for the power supply to the electric motor 26 is not changed for the first locked condition and then the direction for the power supply is reversed for the second locked condition. As a result, it is possible not only to properly release the locked condition but also suppress the generation of the slapping sound between the gears caused by the reversed rotation of the cam shaft 16.

(4) The ECU 30 may store information relating to occurrence of the locked condition and/or release of the locked condition, so that the direction of changing the cam shaft phase may be reversed based on the information for the locked condition. Each of the products may have an individual difference, so that there may be a difference among the respective products in respect of occurrence frequency of the locked condition and/or easiness for releasing the locked condition. Therefore, when the lock releasing control is carried out depending on such individual difference, it is possible to properly release the locked condition for the respective products.

For example, the reversed rotation of the cam shaft 16 may be carried out for the purpose of releasing the locked condition after the stop of the current engine operation, based on the reversed rotational amount (the phase-changing value "Δθ") of the camshaft 16 for the previous lock releasing control after the previous stop of the engine operation. More exactly, the phase-changing value "Δθ" of the cam shaft 16 for the previous lock releasing control is memorized in a back-up memory device as a learning value. It may be better to memorize at the same time whether the locked condition has been released or not. When it will be possible to release the locked condition with the phase-changing value "Δθ" of the cam shaft 16 for the previous lock, releasing control, the lock releasing control may be also carried out this time with the same phase-changing value "Δθ". In the case that the locked condition was not able to be released with the phase-changing value "Δθ" of the cam shaft 16 for the previous lock releasing control, the lock releasing control may be carried out this time with a phase-changing value which is larger than the phase-changing value "Δθ" of the previous lock releasing control.

(5) When a number of execution for the lock releasing control reaches at a predetermined number during the operation for changing the cam shaft phase to the target value "Mtg" after the stop of the engine operation, the lock releasing control may not be carried out thereafter. In the case that the locked condition could not be released even after a certain number of the lock releasing control has been carried out, in most cases the locked condition could not be released by the temporal reversed rotation of the cam shaft 16. Therefore, in such a case, the lock releasing control may be stopped thereafter in order to suppress useless electrical power consumption. In addition, when the number of execution for the lock releasing control reaches at the predetermined number, a malfunction may be informed to a vehicle driver, or such a malfunction may be stored in the back-up memory device.

(6) When the locked condition has occurred at the cam shaft 16 during the valve timing control after the stop of the engine operation, the lock releasing control is carried out once. When the actual cam shaft phase does not reach at the target value "Mtg" even after a predetermined time period has passed over since the lock releasing control had been carried out, no further operation for the lock releasing control may be carried out after such predetermined time period. In the case that the locked condition can not be released even when the lock releasing control (reversing the direction of the power supply) has been carried out for the predetermined time period, the locked condition should be considered as not being released by the temporal reversed rotation of the cam shaft 16. Therefore, when the locked condition can not be released with the reversed direction of the power supply after the predetermined time period, the lock releasing control by reversing the power supply may be stopped thereafter. As in the same manner above, a malfunction may be informed to the vehicle driver, or such a malfunction may be stored in the back-up memory device.

(7) In the above embodiments, the present invention is applied to the VVT apparatus of the electrically-driven type, in which the rotation of the cam shaft 16 for the intake valve is carried out by the electric motor 26 via the phase variable mechanism 21. The present invention may be applied to such a VVT apparatus of a hydraulic type, in which an electric pump is operated by an electric motor to control hydraulic pressure and the cam shaft 16 is rotated by the hydraulic pressure. According to such a VVT apparatus, the phase variable mechanism 21 may not be necessary. A probability of occurrence for the locked condition, which may be caused by loose engagement between gears, may be decreased. On the other hand, a locked condition, which may be caused by a force of the cam shaft for lifting up the intake valve (or the exhaust valve) against the spring force of the intake or exhaust valve, may occur. Therefore, when the present invention is applied to the hydraulic type VVT apparatus, it also has an effect that the cam shaft phase can be surely changed to the target value.

(8) In the above embodiments, the VVT apparatus 18 is provided for the cam shaft 16 of the intake valve. The present invention may be applied to the cam shaft of the exhaust valve.

(9) The present invention is applied to the VVT apparatus having the phase variable mechanism 21 between the electric motor 26 and the camshaft 16. However, the present invention should not be limited to the phase variable mechanism 21, so long as the rotational phase of the camshaft 16 with respect to the crankshaft 12 can be changed by transmitting the rotational force of the electric motor 26 to the cam shaft 16. For example, the present invention may be applied to a VVT apparatus having a link mechanism and/or a guide plate with an arm between the electric motor 26 and the cam shaft 16.

What is claimed is:

1. A control system for a variable valve timing apparatus for an internal combustion engine comprising:

a phase variable mechanism for transmitting rotational force of an electric motor to a cam shaft of the engine to thereby change a rotational phase of the cam shaft with respect to a crank shaft; and an electronic control unit for controlling rotation of the electric motor, wherein the electronic control unit has a target value control portion for controlling the rotational phase of the cam shaft to a target value after engine operation is stopped, wherein the electronic control unit has a locked condition detecting portion for detecting whether a locked condition, in which a change of the rotational phase is stopped or close to a stopped condition, has occurred during an operation of the target value control portion for controlling the rotational phase of the cam shaft to the target value after the engine operation is stopped, and wherein the electronic control unit has a phase control portion for temporarily reversing a direction of changing the rotational phase of the cam shaft, so that the direction is temporarily changed to an opposite direction of changing the rotational phase of the cam shaft to the target value, when the locked condition is detected after the engine operation is stopped, wherein the electronic control unit further has a phase-changing amount setting portion for setting a phase-changing amount when controlling the rotational phase of the cam shaft in the reversed direction after the engine operation is stopped, and the phase control portion carries out the control of the rotational phase of the cam shaft in the reversed direction based on the phase-changing amount set by the phase-changing amount setting portion, after the engine operation is stopped.

2. The control system for the variable valve timing apparatus according to the claim 1, wherein the phase control portion temporarily reverses direction of power supply to the electric motor, so that the direction of changing the rotational phase of the cam shaft is temporarily reversed.

3. The control system for the variable valve timing apparatus according to the claim 1, wherein in a case that the rotational phase of the cam shaft is controlled to the target value after the rotational phase of the cam shaft has been temporarily controlled in the reversed direction by the phase control portion, the electronic control unit carries out a power supply increase control for the power supply to the electric motor for a predetermined time period at starting the power supply increase control, so that the power supply amount to the electric motor is increased to a predetermined power increase value.

4. The control system for the variable valve timing apparatus according to the claim 1, wherein the electronic control unit has a memory portion for storing information relating to occurrence of the locked condition and release of the locked condition, and the phase control portion controls the rotational phase of the cam shaft in the reversed direction based on the information relating to the occurrence and/or release of the locked condition.

* * * * *